United States Patent [19]

Kastenhuber

[11] Patent Number: 4,951,949

[45] Date of Patent: Aug. 28, 1990

[54] LIGHT WEIGHT SPLIT HOSEL AND PUTTER HEAD

[76] Inventor: Lawrence G. Kastenhuber, 1421 N. Geyer Rd., Kirkwood, Mo. 63122

[21] Appl. No.: 318,079

[22] Filed: Mar. 2, 1989

[51] Int. Cl.[5] ..... A63B 53/02; A63B 53/10; A63B 53/12

[52] U.S. Cl. ..... 273/80 A; 273/80 C; 273/80.1; 273/167 G

[58] Field of Search ..... 273/80 R, 80 C, 80.1–80.9, 273/167 R, 167 D, 167 F, 167 G, 167 H, 167 K, 169, 77 R; D21/221; 403/404

[56] References Cited

U.S. PATENT DOCUMENTS

| | | | |
|---|---|---|---|
| D. 91,336 | 1/1934 | Thompson | 273/80 R X |
| D. 188,857 | 9/1960 | Mospan | D21/219 |
| D. 209,301 | 11/1967 | Comitz | 273/167 G X |
| D. 217,873 | 6/1970 | Steele | 273/80.1 X |
| D. 220,844 | 6/1971 | Letters | 273/167 D X |
| D. 223,031 | 2/1972 | Ernst | D21/219 |
| D. 223,767 | 6/1972 | Houghtaling | 273/167 G X |
| 687,539 | 11/1901 | Palmer | 273/80.2 |
| 1,116,417 | 11/1914 | Hackbarth | 273/164 |
| 1,652,404 | 12/1927 | Graveure | 273/168 |
| 1,952,624 | 3/1934 | Inman et al. | 273/167 R |
| 2,644,689 | 7/1953 | Putnam | 273/79 |
| 3,675,923 | 7/1972 | Allen et al. | 273/80.2 |
| 3,873,094 | 3/1975 | Sebo et al. | 273/163 R |
| 3,992,015 | 11/1976 | Benson | 273/80.2 |
| 4,147,357 | 4/1979 | Strop | 273/164 |
| 4,793,616 | 12/1988 | Fernandez | 273/167 H |

FOREIGN PATENT DOCUMENTS

| | | | |
|---|---|---|---|
| WO/8403447 | 9/1984 | European Pat. Off. | 273/81 B |
| 558183 | 1/1975 | Switzerland | 273/80 C |
| 1232651 | 5/1971 | United Kingdom | 273/80 C |

*Primary Examiner*—William H. Grieb
*Assistant Examiner*—Sebastiano Passaniti
*Attorney, Agent, or Firm*—Robbins & Robbins

[57] ABSTRACT

A split hosel and putter head is provided. The split hosel is of an inverted V-shape and is connected by a short shank at the top to a golf club shaft and at the bottom to the heel and toe of the putter head through slots in the head. The hosel is light in weight and when employed with a putter head of perimeter weighting construction concentrates the impact of the putter stroke upon the golf ball to minimize torque and twisting occasioned by off-center impacts.

8 Claims, 3 Drawing Sheets

FIG 5
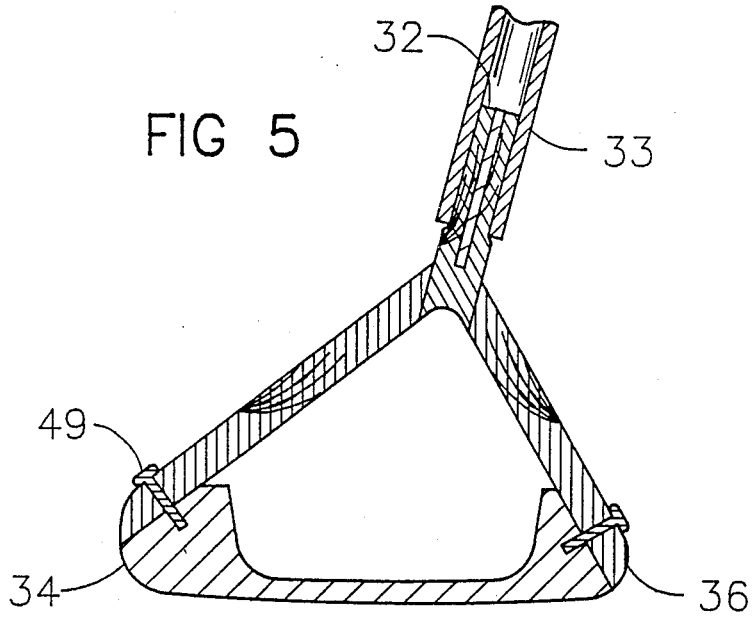
FIG 4
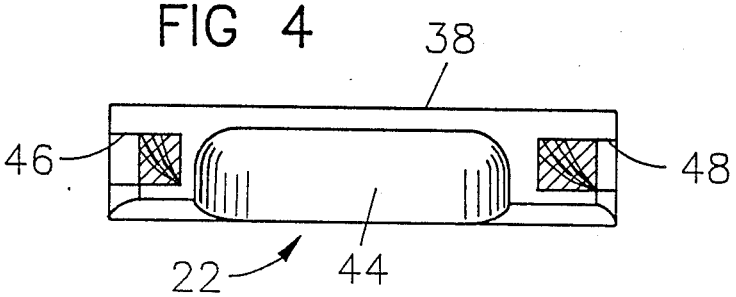
FIG 2
FIG 3
FIG 1
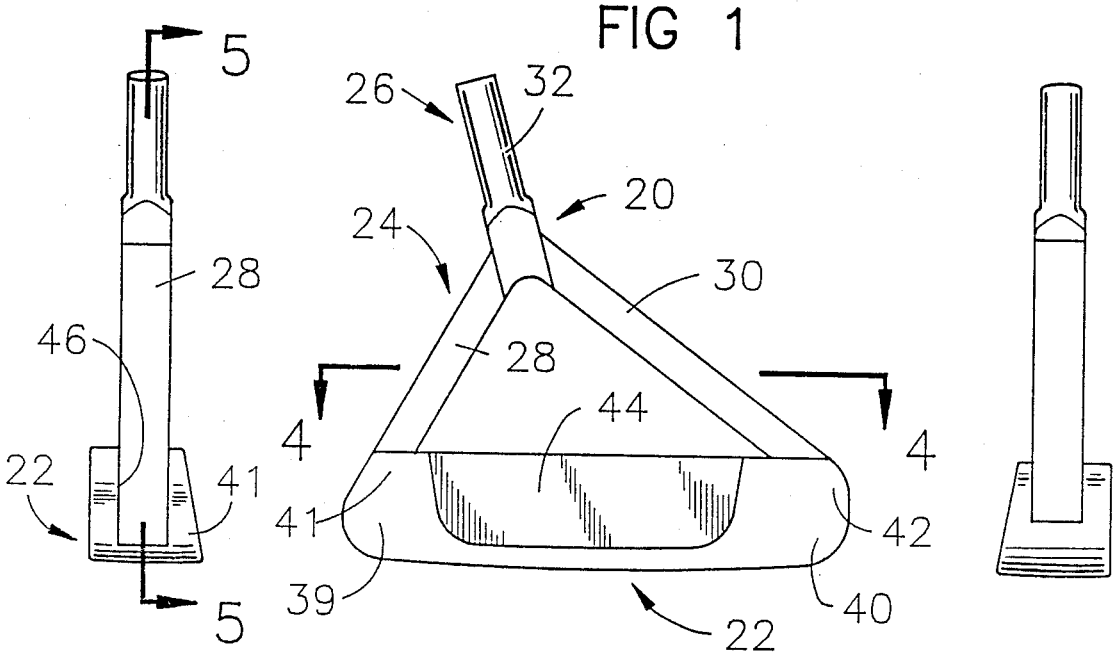

FIG 10
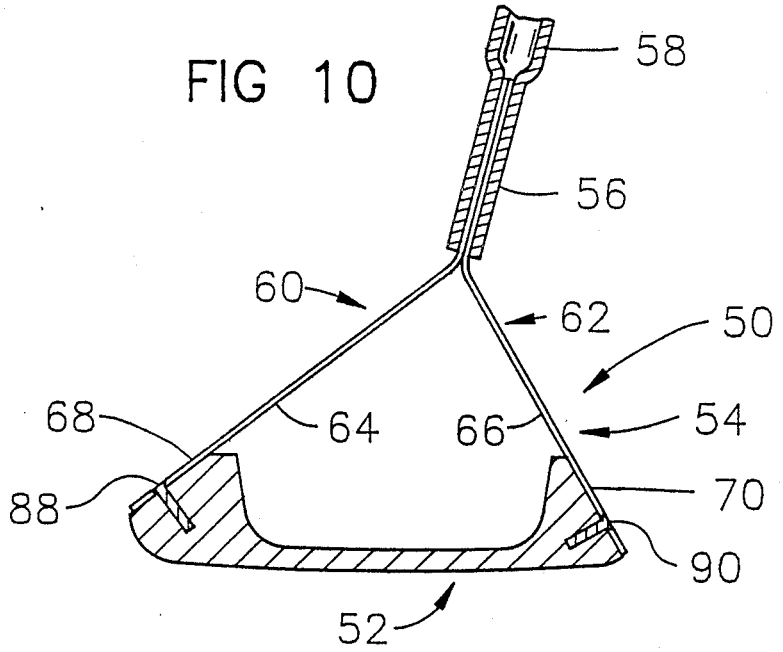
FIG 9
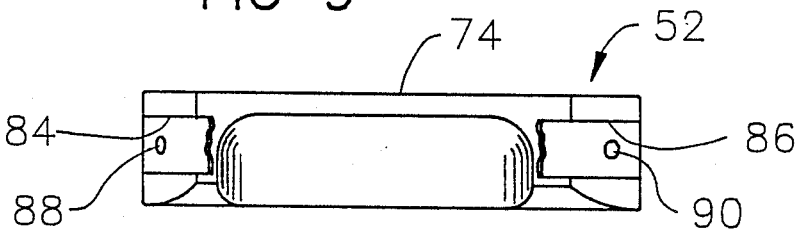
FIG 7
FIG 8
FIG 6
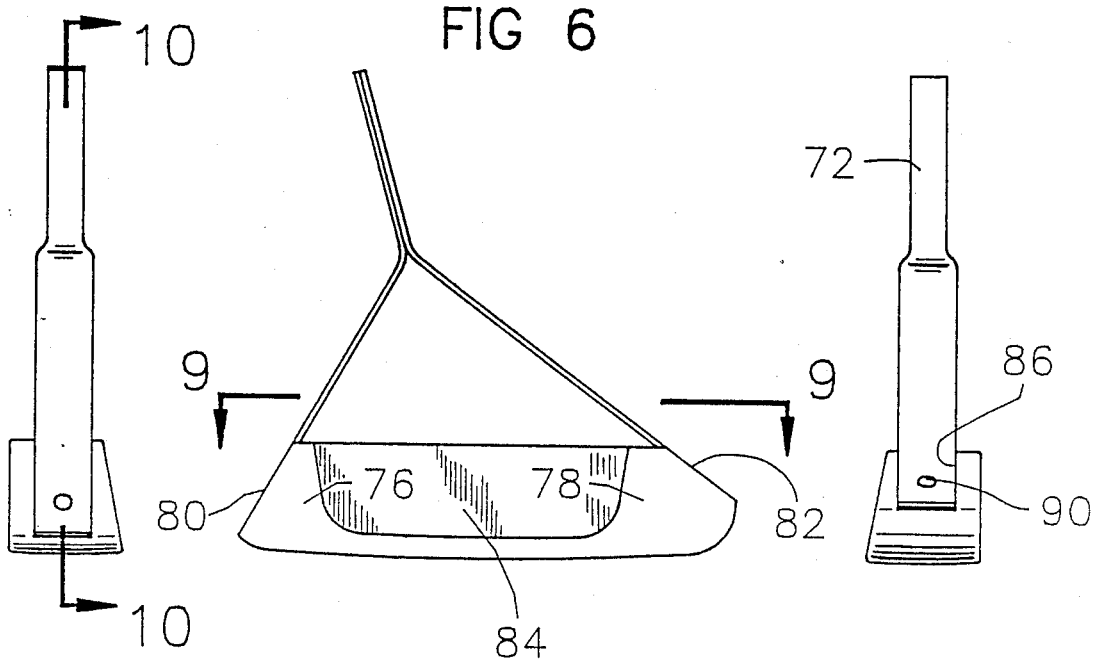

FIG 14
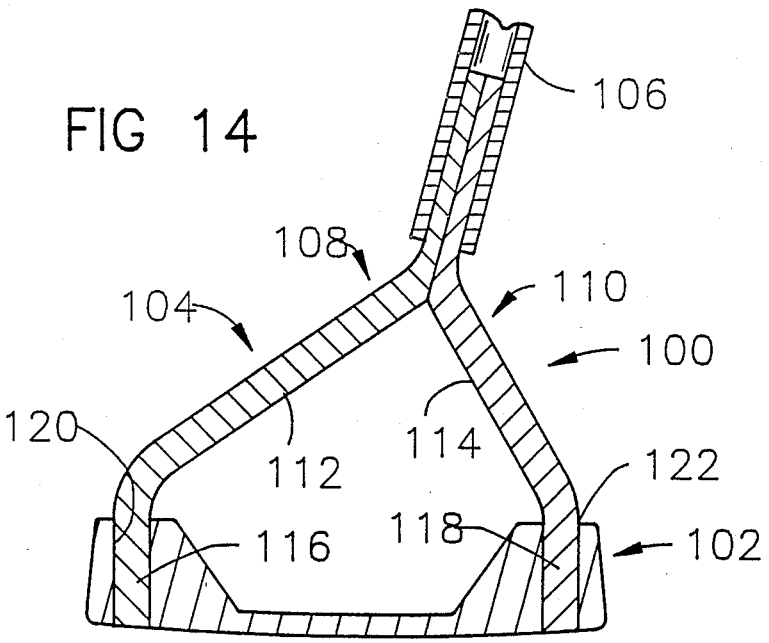
FIG 13
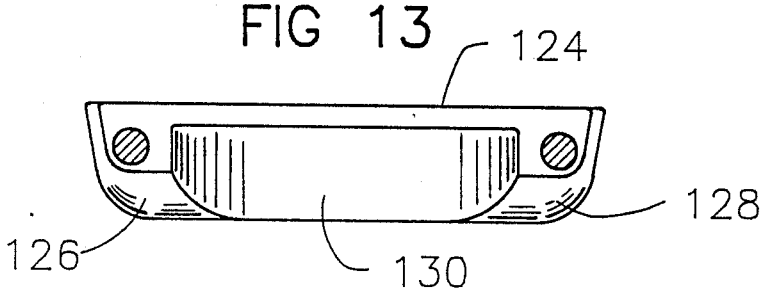
FIG 11
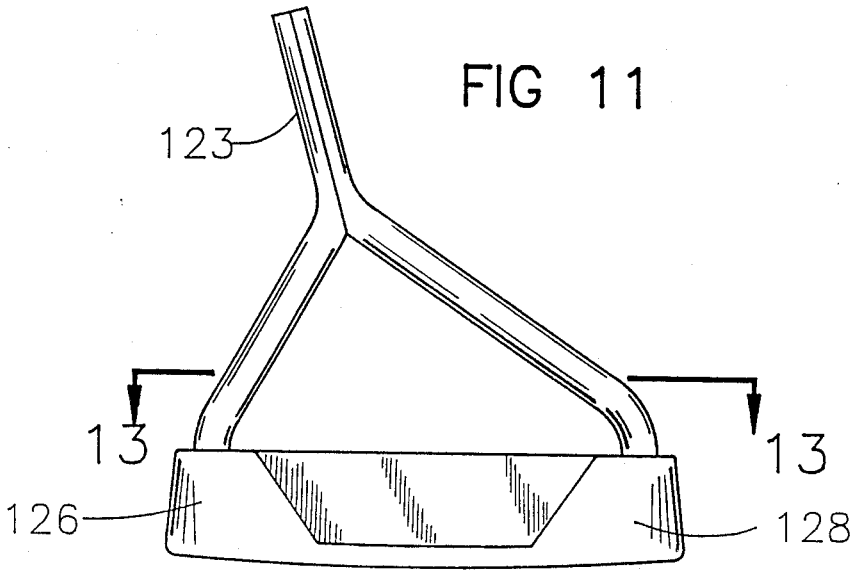
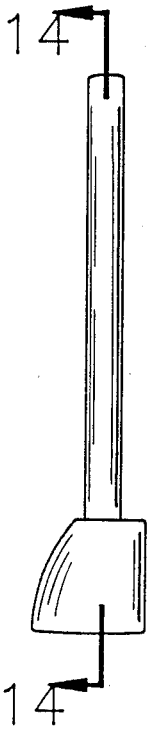
FIG 12

LIGHT WEIGHT SPLIT HOSEL AND PUTTER HEAD

BACKGROUND OF THE INVENTION

Conventional putters used in golf have a single hosel connecting the putter head or putter blade to the putter shaft. They have just one ideal point of forward thrust provided by impact of the putter head upon the golf ball. This necessitates the ball being struck at the center of the putter head or "sweet spot".

If a ball is struck slightly off-center, toward the heel or toe of the putter head, an undesirable twisting action or torque is effected tending to cause the ball to be putted to the right or left of the desired path of travel. Tests have shown that when a ball is struck off the sweet spot or center of gravity there is little torsion or torque where the thrust points are at both ends, i.e., the heel and toe of the golf blade.

Further, it has long been an object in the design of golf clubs to locate the center of gravity of the club head as low as possible. This had been accomplished in various designs by a bottom flange or the like at the rear of the club head.

While some golf putter heads have provided a split hosel connecting the head to the shaft, the head and hosel have been of an integral design. There has remained a need for a putter in which the thrust form impact can be delivered to the heel and toe combined with a low center of gravity.

SUMMARY OF THE INVENTION

By means of the instant invention there has been provided a putter head using perimeter weighting with a light weight split hosel which provides thrust to the heal and toe of the club head and a low center of gravity.

The split hosel is light in weight and is simply connected to the heel and toe through slots provided in the putter head. The hosel is of an inverted V or Y shape and is of a yoke-like nature with a short stub shaft which may be fitted within the lower end of a conventional tubular putter shaft. The split hosel is one-third to one-half the weight of a conventional hosel and by virtue of the light weight a lower center of gravity is provided to the bottom of the putter to focus the force of impact through the putter head.

In one embodiment, the split hosel is constructed of light weight hard wood, while in other embodiments rigid steel straps may be employed as well as aluminum rods. The separate light weight split hosel construction avoids the additional weight provided in conventional putter heads where the head and hosel are molded in a unitary, integral construction from the brass, bronze or steel metals conventionally employed.

The split hosel may be simply connected to the putter head througb slots provided at the heel and toe of the blade. The slots receiving lower ends of the arms of the split hosel may be in the form of slanted grooves at the heel and toe ends of the putter or drilled holes which receive vertical end portions of hosel arms. The connection of the split hosel arms is on a relatively thickened heel and toe portion bridging a central hollowed out portion. By this construction perimeter weighting is obtained to deliver thrust or force to both the heel and toe portions equally to minimize torque or twist to off-center impact of the putter head upon the golf ball.

The improved putter head and light weight split hosel of this invention provide an easily employed putter which may be employed in conventional fashion. By virtue of the separate split hosel construction different designs of putter heads may be provided without the necessity of separate mold for each new combination.

The above features are objects of this invention. Further objects will appear on the detailed description which follows and will be further apparent to those skilled in the art.

For the purpose of illustration of the invention, there is shown in the accompanying drawings an embodiment and modifications of the putter head and hosel. It is to be understood that the drawings are for example only and that the invention is not limited thereto.

IN THE DRAWINGS

FIG. 1 is a view in rear elevation of the putter head and hosel;

FIG. 2 is a view in side elevation taken from the left side of FIG. 1;

FIG. 3 is a view in side elevation taken from the right side of FIG. 1;

FIG. 4 is is a view in section taken on the line 4—4 of FIG. 1;

FIG. 5 is a view in section taken on the line 5—5 of FIG. 2;

FIG. 6 is a view in rear elevation of a modified putter head and hosel;

FIG. 7 is a view in side elevation taken from the left side of FIG. 6;

FIG. 8 is a view in side elevation taken from the right side of FIG. 6;

FIG. 9 is a view in section taken on the line 9—9 of FIG. 6; and

FIG. 10 is a view in section taken on the line 10—10 of FIG. 7;

FIG. 11 is a view in rear elevation of a further modified putter head and hosel;

FIG. 12 is a view in side elevation taken from the right side of FIG. 11;

FIG. 13 is a view in section taken on the line 13—13 of FIG. 11; and FIG. 14 is a view in section taken on the line 14—14 of FIG. 12.

DESCRIPTION OF THE INVENTION

The split hosel and putter head of this invention is generally indicated by the reference numeral 20 in FIGS. 1 through 5. It is comprised of a putter head 22 and a split hosel 24 connected to the lower end 26 of a tubular putter shaft.

The split hosel is light weight by virtue of construction from wood which preferably is a hard wood such as oak, ash, persimmon or the like. By virtue of the wood construction, the hosel is in the order of less than about one-third to one-half the weight of conventional hosels, many of which are integrally formed with the putter head in a molding or casting operation employing brass, bronze, steel or other metals. Conventional putter heads are constructed of steel, brass, bronze or aluminum having specific gravities of about 7.7, 8.5, 8.8 and 2.7, respectively. Wood such as oak, ash or persimmon has a specific gravity of about 0.60 to 0.90.

The split hosel is formed with two arms 28 and 30 which are connected at the top by gluing or other means of affixation to a stub shaft 32. The stub shaft fits within a tubular bottom end 33 of the putter shaft. The arms are slanted with a V-shape slightly to the rear of the putter with the axis and that of the stub shaft slanted in such a manner that the axis is directed substantially to the center or "sweet spot" of the putter to focus the putter impact on the ball.

The lower ends 34 and 36 of the hosel arms are rounded at their end to be flush with heel and toe ends of the putter head as will be described hereinbelow.

The putter head 22 as best shown in FIGS. 1, 4 and 5 is provided with a vertical front face 38 and slanting heel and toe end portions 39 and 40 with slanting end faces 41 and 42 respectively. The heel and toe portions bridge a central hollowed out portion 44 to provide a greater weight at the heel and toe end portions. This weight distribution effects a perimeter weighting construction to deliver thrust equally to the heel and toe to minimize torque or twist forces when the putter head strikes the ball off-center or away from the "sweet spot".

For affixation of the lower ends of the split hosel arms to the putter head, the heel and toe portions are provided with slots 46 and 48. These slots are slanted and snugly receive the diverging end portions of the hosel arms in closely fitting relation. Anchoring of the ends of the arms may be provided by a pair of pins 49 or gluing or a combination of both. It should be noted that while the slots are shown in the forms of grooves having a square or rectangular configuration to fit the square cross-section of the hosel arms, other shapes for the hosel arms and grooves may be employed as desired as long as the hosel arms can be fitted over and into the slots.

A modified split hosel and putter head is generally indicated by the reference numeral 50 in FIGS. 6–10. It is comprised of a putter head 52 and a split hosel 54 adapted to be connected to a flattened lower end 56 of a tubular putter shaft 58.

The split hosel is constructed of two pieces, flat strap steel 60 and 62, or the like having a narrow rectangular cross section in which the long side of the cross section rectangular is aligned with the path of the ball to absorb impact.

The two pieces of strap steel are of relatively light weight compared to the conventional hosel being of about one-half the weight. The two pieces, 60 and 62 have separate arms 64 and 66 having lower end portions 68 and 70 which are adapted to be connected to the heel and toe of the putter head 52. The top portions of the two pieces of strap steel are connected together at the top portion by welding, brazing, cementing or the like to form a stub shaft 72 which is fitted into the lower end 56 of the putter shaft.

The putter head 52 as best shown in FIGS. 6, 9 and 10 is provided with a vertical front face 74 and heel and toe portions 76 and 78 with slanting end faces 80 and 82. The heel and toe portions bridge a central hollowed out portion 84 as in the embodiment of FIG. 1 to provide perimeter weighting.

In order to receive the end portions 68 and 70 of the split hosel, the end faces 80 and 82 of the heel and toe portions of the putter head are provided with slots 84 and 86 in the form of narrow rectangular grooves. The end portions are snugly fitted into the slots and may be fixed by pins 88 and 90 or where desired maybe welded, brazed, cemented or the like.

A further modification is generally indicated by the reference numeral 100 in FIGS. 11 through 14. As in the other embodiments, it is comprised of a putter head 102 receiving a split hosel 104 which is fitted into the lower tubular end 106 of a putter shaft.

The split hosel is constructed of two pieces 108 and 110 of aluminum rods to provide a light weight approximation about one-half that of conventional hosels. The rods are formed into two inverted V-shaped arms, 112 and 114, having vertical end portions 116 and 118 which are adapted to be fitted into slots 120 and 122 in the putter head. The top portions of the two arms are connected together in the same fashion as the split hosel 50 of FIGS. 6–10 to form a stub shaft 123 which is fitted into the lower tubular end of the putter shaft as shown in FIG. 14. The putter head may be desirably formed of steel, brass or bronze having specific gravities of more than twice that of aluminum.

The putter head 102, as in the previous embodiments, has a front face 124 and heel and toe portions 126 and 128 which bridge a central hollowed out portion 130 to provide the afore-mentioned perimeter weighting. The slots 120 and 122 are provided in the form of vertical drilled holes into which the end portions 116 and 118 of the split hosel are interfitted. Connection and affixation may be effected in the manner previously described for the embodiment 50 of FIGS. 6–10 by welding, brazing, cementing, pinning or the like.

All three of the split hosel and putter head embodiments 20, 50 and 100 are simply fabricated by interfitting of the lower end portions of the split hosel into the slots of the putter head with simple affixation. In like manner, the stub shaft is simply fitted into and fixed to a lower tubular end portion of a conventional putter shaft. The putter with the split hosel and putter head of this invention may then be employed to provide a low center of gravity putter with equalized thrust through the split hosel arm connection to the heel and toe of the putter to provide as true a path of the putted golf ball as possible.

Various changes and modifications may be made within this invention as will be apparent to those skilled in the art. Such changes and modifications are within the scope and teaching of this invention as defined in the claims appended hereto.

What is claimed is:

1. A split hosel and putter head, said putter head being integral and having a heel and toe portion at opposite ends of the putter head and bridging a hollowed out central portion at the rear of the putter head, said split hosel comprising a pair of light weight hosel arms having connecting means for affixation to said putter head, said hosel arms converging in an inverted V-shaped relationship at a top portion into a stub shaft connected to a lower tubular end of a putter shaft, said connecting means comprising a slot in each of the heel and toe portions in top surfaces thereof receiving lower ends of said hosel arms, said slots being aligned to simply and interfittingly receive the lower ends of said hosel arms through said top surfaces, said split hosel being constructed of a material having substantially less than one-half the specific gravity of the putter head.

2. The split hosel and putter head of claim 1 in which said connecting means comprises axially extending grooves in slanted end faces of said heel and toe portions of the putter head, said lower ends of said hosel arms being fixed to the heel and toe portions in said slots.

3. The split hosel and putter head of claim 2 in which said split hosel is constructed of wood.

4. The split hosel and putter head of claim 2 in which said split hosel is constructed of strap metal and said slots have a shallow rectangular configuration, said strap metal being aligned in a path perpendicular to a front face of the putter head.

5. The split hosel and putter head of claim 4 in which said hosel arms are connected together at a top portion to form said stub shaft which is receivable in said lower end of the tubular shaft of the putter shaft.

6. The split hosel and putter head of claim 1 in which said slots comprise vertical holes in the heel and toe portion and said lower ends of said hosel arms extend vertically and are received in said vertical holes and connected to the heel and toe portions therein.

7. The split hosel and putter head of claim 6 in which said hosel arms are constructed of aluminum rods.

8. The split hosel and putter head of claim 6 in which said hosel arms are connected together at a top portion to form said stub shaft which is receivable in said lower end of the tubular shaft of the putter shaft.

* * * * *